US006039776A

United States Patent [19]

Liue et al.

[11] Patent Number: 6,039,776

[45] Date of Patent: Mar. 21, 2000

[54] CLEANING DEVICE FOR AVOIDING DISSIPATION OF POLLUTED AIR DUE TO SMOKING

[76] Inventors: Yung-Ho Liue, Room 18, 13F, No. 4, Shi-Ning South Rd.; Kung-An Chiang, No. 1, Alley 32, Lane 76, Sec. 2, Ho-Ping E. Rd., both of Taipei, Taiwan

[21] Appl. No.: 09/208,252

[22] Filed: Dec. 9, 1998

[51] Int. Cl.[7] ..... B01D 53/00

[52] U.S. Cl. ..... 55/385.1; 55/385.8; 15/313

[58] Field of Search ..... 55/385.1, 385.8; 15/313

[56] References Cited

U.S. PATENT DOCUMENTS

| | | | |
|---|---|---|---|
| 2,299,668 | 10/1942 | Webster | 15/313 |
| 3,958,965 | 5/1976 | Raczkowski | 55/385.8 |
| 4,043,776 | 8/1977 | Orel | 55/385.8 |
| 4,119,419 | 10/1978 | Passara et al. | 55/385.8 |
| 5,085,134 | 2/1992 | Hofstra et al. | 55/385.8 |
| 5,649,997 | 7/1997 | Cavallero et al. | 55/385.8 |

FOREIGN PATENT DOCUMENTS

| | | | |
|---|---|---|---|
| 3125623 | 5/1991 | Japan | 55/385.1 |

*Primary Examiner*—Jay H. Woo
*Assistant Examiner*—Minh-Chan T. Pham
*Attorney, Agent, or Firm*—Bacon & Thomas, PLLC

[57] ABSTRACT

A cleaning device for avoiding dissipation of polluted air due to smoking, including a chair body, a gas-collecting funnel, a sucking device, a filtering box and a control circuit. A main power switch is disposed on the chair body. The gas-collecting funnel can be pulled downward and extensibly opened to restrain the polluted air due to smoking within the funnel. An ash tray is disposed on an arm rest of the chair body. A microswitch is installed at the bottom of the ash tray for controlling the operation of the sucking device. The polluted air is sucked from the funnel through a gas conduit into the filtering box to be filtered and purified by a filtering cotton and active carbon. Therefore, the air can be cleaned and recycled and the dissipation of polluted air is avoided.

2 Claims, 4 Drawing Sheets

CLEANING DEVICE FOR AVOIDING DISSIPATION OF POLLUTED AIR DUE TO SMOKING

BACKGROUND OF THE INVENTION

The present invention relates to a cleaning device for avoiding dissipation of polluted air due to smoking, and more particularly to a cleaning device including a gas-collecting funnel for collecting polluted air due to smoking. A sucking device is used to suck the polluted air into a filtering device for purifying the air and avoiding dissipation of the polluted air. The cleaning device is applicable to public sites such as movie theater, bus, airplane, sport court, etc.

An air cleaner is used to purify and recycle the air. A conventional air cleaner is formed by an intake mechanism and a filtering device. However, such the air cleaner lacks a gas-collecting device so that in a public site, the conventional air cleaner fails to effectively avoid dissipation of the polluted air due to smoking. Therefore, in an open space, the air cleaner can hardly prevent the polluted air from dissipating and thus the health of other people can be hardly ensured.

SUMMARY OF THE INVENTION

It is a primary object of the present invention to provide a cleaning device which is able to avoid dissipation of polluted air due to smoking, whereby a smoker can smoke in a public site without affecting other people and threatening the health of those people who do not smoke.

It is a further object of the present invention to provide the above cleaning device which is able to collect and filter the polluted air so as to purify and recycle the air.

According to the above objects, the cleaning device of the present invention includes a chair body, a gas-collecting funnel, a sucking device, a filtering box and a control circuit. The gas-collecting funnel is disposed on the upper side of the chair body and can be pulled downward and extensibly opened to restrain the polluted air due to smoking within the funnel. An end of the funnel is communicated with a sucking port which is communicated with the filtering device and the sucking device via a gas conduit. The filtering box has a smaller gas inlet and a larger gas outlet. A filtering cotton and active carbon are disposed in the filtering box. The control circuit includes an ash tray disposed on an arm rest of the chair body, a microswitch installed at the bottom of the ash tray for controlling the operation of the sucking device and a main power switch disposed on the gas-collecting funnel. An expansion valve is disposed on the front side of the filtering box.

After a smoker sits on the chair body, the gas-collecting funnel is pulled downward and the main power switch is switched on. When the smoker's hand depresses the ash tray, the microswitch is activated to turn on a sucking motor for sucking the gas. At this time, the polluted air is sucked from the sucking port of the upper end of the funnel through the conduit into the filtering box. The air is then filtered and purified by the filtering cotton and the active carbon. The gas inlet of the filtering box is smaller than the gas outlet thereof so that the air can be fully filtered. A check valve is disposed on an intake side of the sucking motor. When the pressure of the incoming air is greater than a certain value, the expansion valve in an expansion room is opened to switch the expansion valve switch and cut off the power for the sucking motor. After the pressure in the expansion room is decreased, the expansion valve is automatically restored to turn on the power for the sucking motor for further sucking operation. Accordingly, the polluted air due to smoking is restrained within the gas-collecting funnel without dissipating and the polluted air is purified to avoid pollution of a public site.

The present invention can be best understood through the following description and accompanying drawings, wherein:

DETAILED DESCRIPTION OF THE PREFERRED EMBODIMENT

Figure 1:
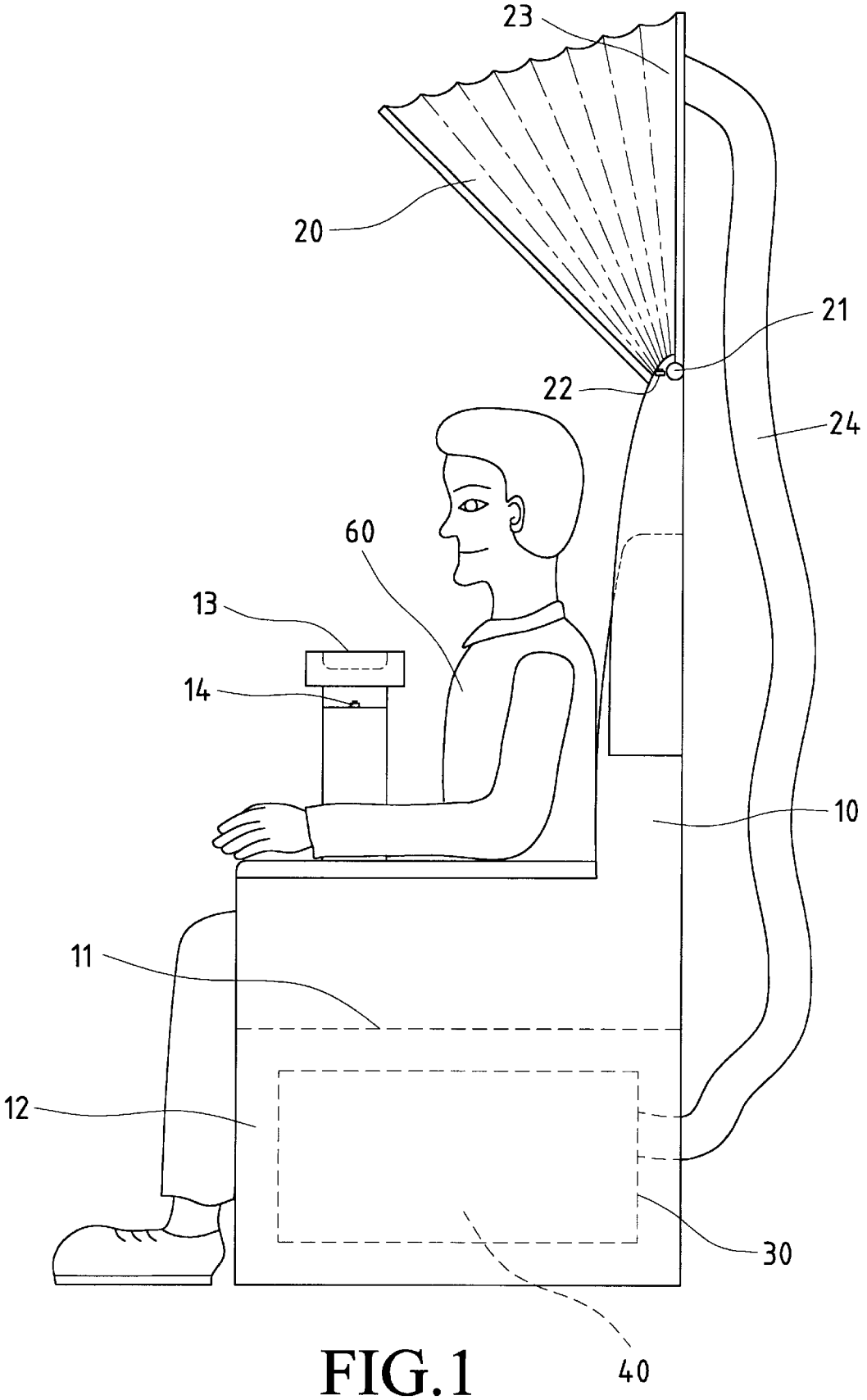
FIG. 1 is a side view of the present invention.
Figure 2:
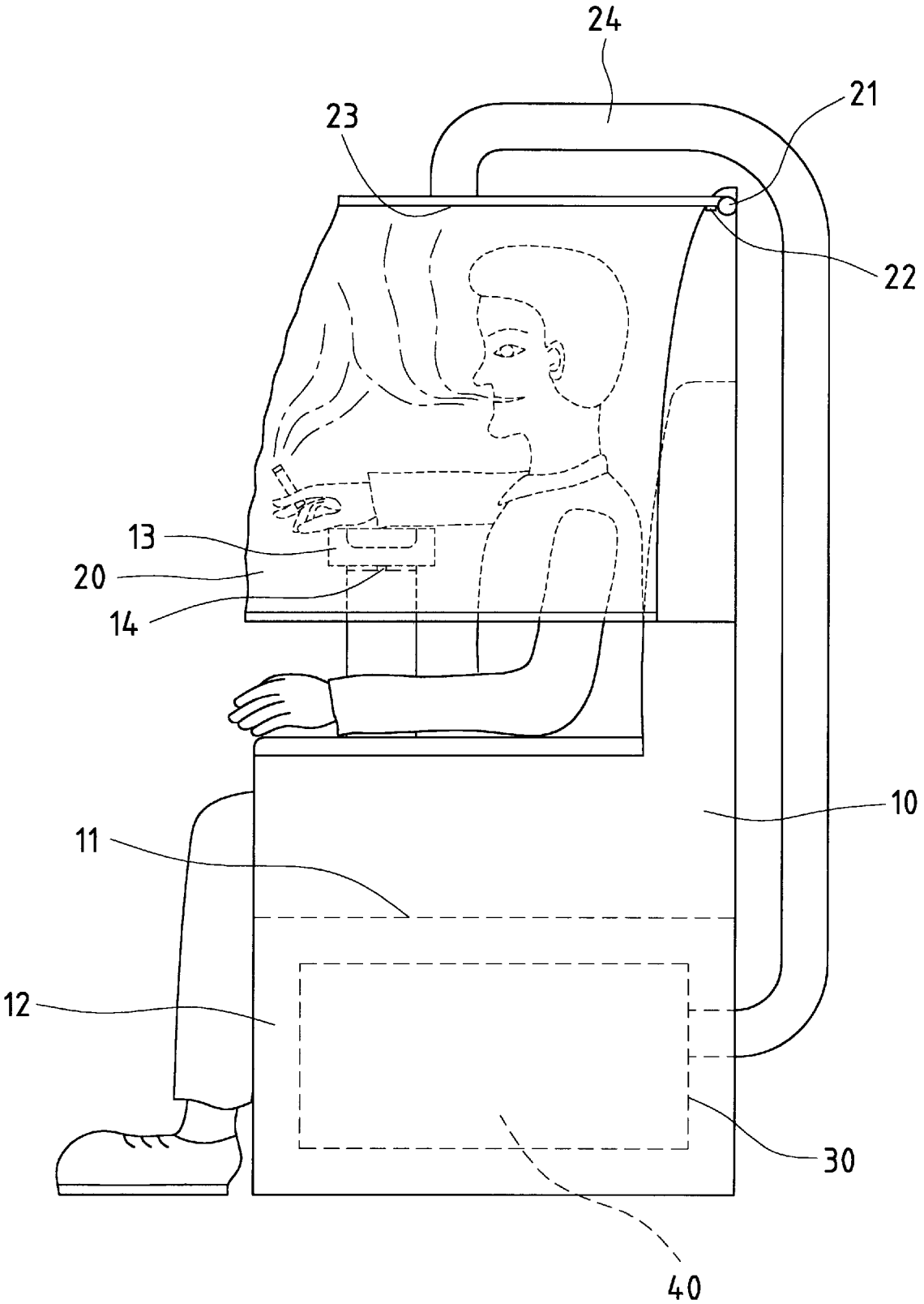
FIG. 2 is a side view according to FIG. 1, showing that the gas-collecting funnel is pulled downward in a working state.

Please refer to FIGS. 1 and 2. The cleaning device of the present invention includes a chair body 10, a gas-collecting funnel 20, a sucking device 30, a filtering box 40 and a control circuit 50.

The chair body 10 is equipped with a seat pad board 11 and formed with a chamber 12 under the pad board 11. An ash tray 13 is mounted on a stem upward extending from an arm rest. A sucking motor switch 14 is disposed on the bottom of the ash tray 13.

The gas-collecting funnel 20 is connected to a top end of the chair body 10 by a coupler 21. The funnel 20 can be pulled downward and extensibly opened. The funnel 20 can be made of transparent material. A main power switch 22 is disposed on the chair back at the end of downward pulling travel of the funnel. The end of the funnel 20 is communicated with a sucking port 23 which is communicated with the sucking device 30 and the filtering box 40 by a gas conduit 24.

Figure 3:
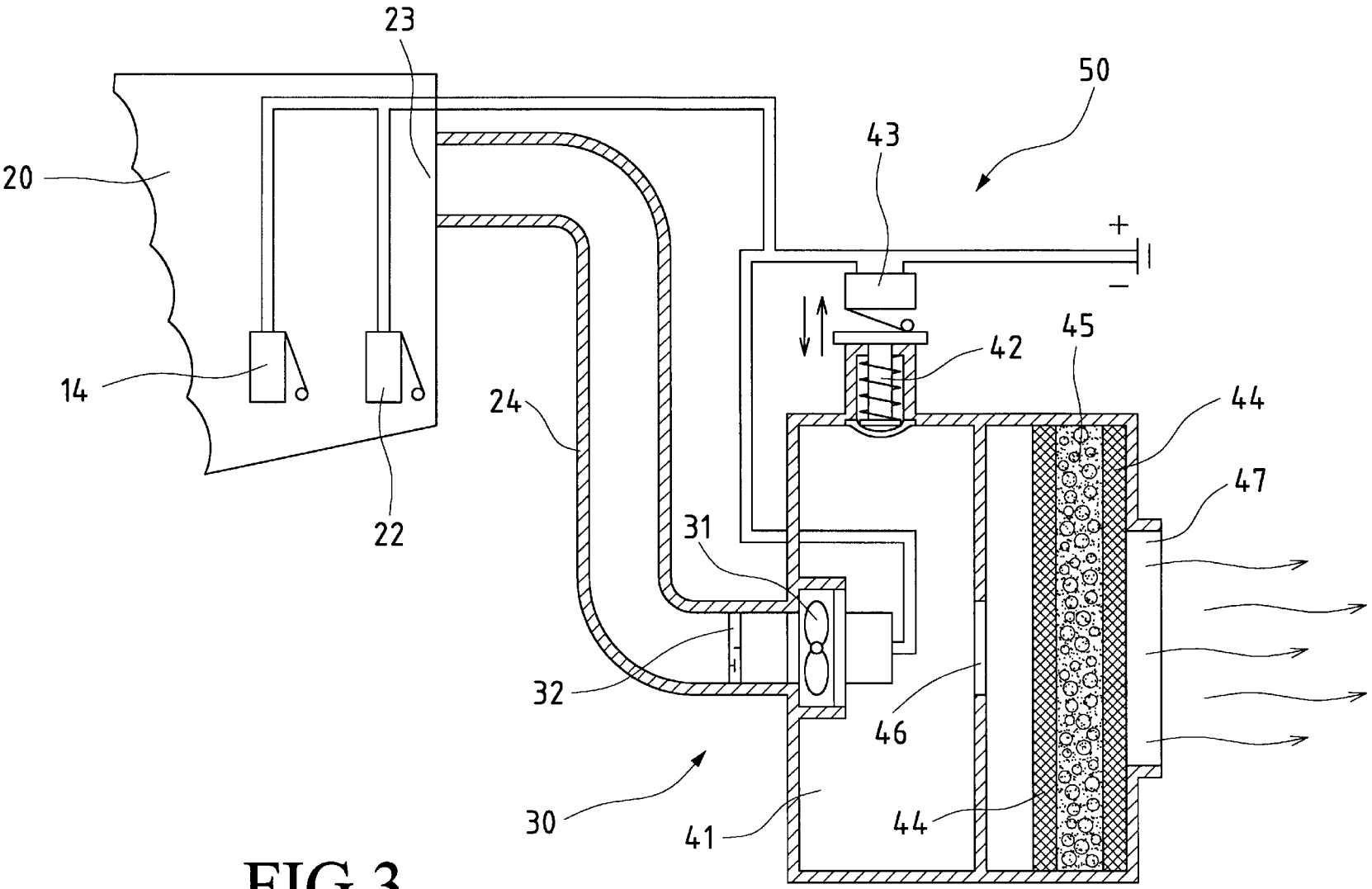
FIG. 3 is a sectional view of the controlling system of the present invention.
Figure 4:
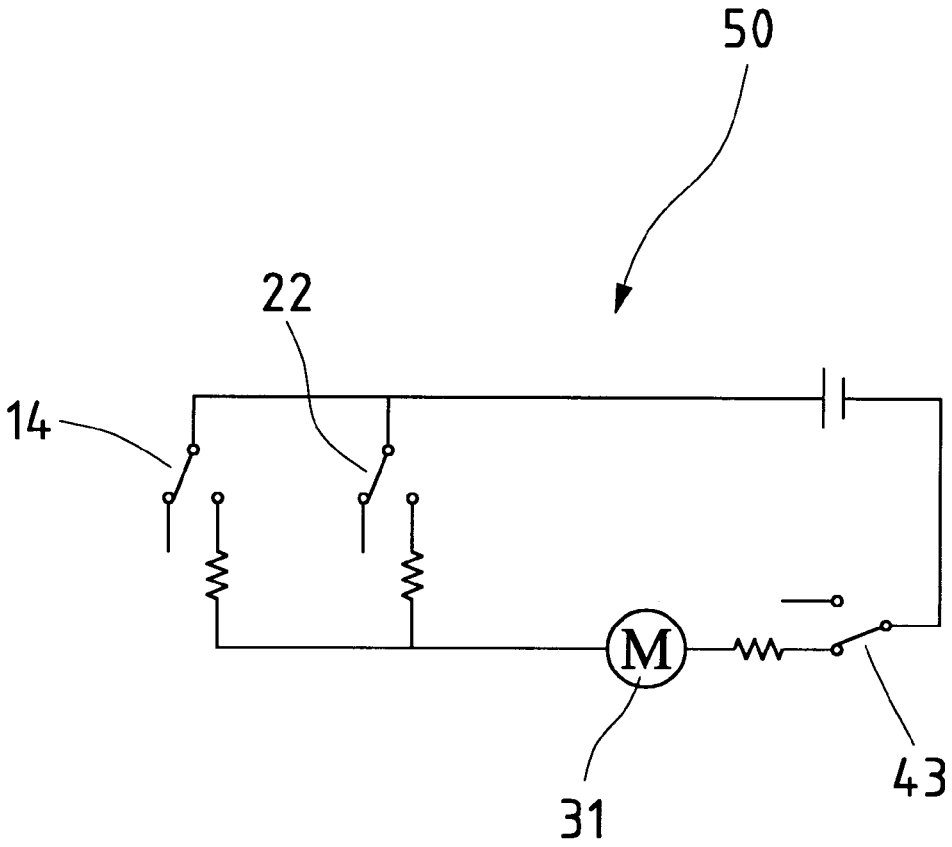
FIG. 4 is a circuit diagram of the control circuit of the present invention.

Referring to FIG. 3, the sucking device 30 and the filtering box 40 are disposed in the chamber 12 of the chair body 10. The sucking device 30 is connected with a sucking motor 31 at the end of the conduit 24. The front side of the sucking motor 31 is equipped with a check valve 32. The power wire of the motor is connected to the main power switch 22 and the sucking motor switch 14. The filtering box 40 is formed with an expansion room 41 in which an expansion valve 42 is disposed. A normally close-type expansion valve switch 43 is arranged on the expansion valve 42. The expansion valve switch 43 is controlled to switch on/off, serving as another switch for the sucking motor 31. A filtering cotton 44 and active carbon 45 are disposed in the filtering box 40. The expansion room 41 is formed with a smaller gas inlet 46. A rear end of the filtering box 40 is disposed with a larger gas outlet 47. Therefore, the gas intake speed of the gas passing through the filtering cotton 44 and the active carbon 45 is slower than the exhaustion speed of the filtered gas so that the gas can be fully filtered to purify the gas.

Please refer to FIGS. 1 to 4. After a smoker 60 sits on the chair body 10, the gas-collecting funnel 20 is pulled downward to enclose an air pollution area (as shown in FIG. 2) so as to limit the flowing area of the polluted air. When the smoker's hand depresses the ash tray 13, the sucking motor switch 14 is activated to turn on the sucking motor 31 for sucking. At this time, a great amount of polluted air is sucked from the sucking port 23 of the upper end of the funnel 20 into the conduit 24 and then passes through the expansion room 41 of the filtering box 40. Thereafter, the air gets into the inlet 46 to be filtered by the filtering cotton 44 and the active carbon 45. The outlet 47 is larger than the inlet 46 and the check valve 32 is disposed on the inlet side of the expansion room 41 so that the pressure in the expansion room 41 will be gradually increased. After the pressure reaches a certain value, the expansion valve 42 is opened to indirectly switch the expansion valve switch 43 and cut off the power. At this time, the sucking motor 31 will stop for a certain period of time. After the pressure in the expansion room 41 is decreased, the power will be restored so as to save energy.

According to the above arrangement, the cleaning device of the present invention is able to avoid dissipation of the pollutant smoke and is able to filter and purify the polluted air. Accordingly, in a public site, air pollution due to smoking can be avoided.

It should be noted that the above description and accompanying drawings are only used to illustrate one embodiment of the present invention, not intended to limit the scope thereof. Any modification of the embodiment should fall within the scope of the present invention.

What is claimed is:

1. A cleaning device for avoiding dissipation of polluted air due to smoking, comprising:

a chair body disposed with a seat pad board and formed with a chamber under the seat pad board, an ash tray being disposed on an arm rest of the chair body, a sucking motor switch being disposed at a bottom of the ash tray;

a gas-collecting funnel connected with a top end of the chair body by a coupler, the funnel being extensibly downward pullable and openable, a main power switch being disposed on a chair back at an end of the downward pulling travel of the funnel, an end of the funnel being communicated with a sucking port which is communicated with a sucking device by a gas conduit;

a sucking device including a sucking motor, a check valve being disposed on a gas inlet side of the sucking motor, an expansion room being disposed on a rear side of the sucking motor, an expansion valve being disposed in the expansion room, an expansion valve switch being disposed on the expansion valve for switching on/off the power for the sucking motor; and a filtering box disposed on a rear side of the sucking device and having a smaller gas inlet and a larger gas outlet, a filtering cotton and active carbon being disposed in the filtering box, whereby the sucking device and the filtering box are installed in the bottom of the chair body and a smoker sits on the chair body with the gas-collecting funnel pulled downward to restrain the waste smoke gas within the funnel, the sucking device sucking the polluted air through the gas conduit into the filtering box to be purified.

2. A cleaning device as claimed in claim 1, wherein the gas-collecting funnel is made of transparent material.

* * * * *